US008992040B2

(12) United States Patent
Henri et al.

(10) Patent No.: US 8,992,040 B2
(45) Date of Patent: Mar. 31, 2015

(54) LED BEACON OBSTRUCTION LIGHTING SYSTEM

(75) Inventors: Marc Henri, La Prairie (CA); Louis Leblanc, Laval (CA); Patrick Bergevin, Laval (CA)

(73) Assignee: 3173879 Canada Inc. (OTL), Laval, Quebec (CA)

( * ) Notice: Subject to any disclaimer, the term of this patent is extended or adjusted under 35 U.S.C. 154(b) by 336 days.

(21) Appl. No.: 12/661,863

(22) Filed: Mar. 24, 2010

(65) Prior Publication Data

US 2010/0259929 A1 Oct. 14, 2010

(30) Foreign Application Priority Data

Mar. 25, 2009 (CA) ..... 2660109

(51) Int. Cl.

| | |
|---|---|
| ***F21V 7/20*** | (2006.01) |
| ***F21V 29/00*** | (2006.01) |
| *F21W 111/06* | (2006.01) |
| *F21Y 101/02* | (2006.01) |

(52) U.S. Cl.

CPC ..... *F21V 29/2237* (2013.01); *F21V 29/004* (2013.01); *F21V 29/2262* (2013.01); *F21V 29/26* (2013.01); *F21W 2111/06* (2013.01); *F21Y 2101/02* (2013.01)

USPC ..... 362/218; 362/249.02; 362/294

(58) Field of Classification Search

USPC ..... 362/20, 218, 234, 235, 249.02, 294, 362/311.02, 545, 547, 555, 580, 800

See application file for complete search history.

(56) References Cited

U.S. PATENT DOCUMENTS

| | | | | |
|---|---|---|---|---|
| 2004/0252520 | A1* | 12/2004 | Martineau et al. | 362/545 |
| 2006/0120083 | A1* | 6/2006 | Trojanowski et al. | 362/294 |
| 2008/0291695 | A1* | 11/2008 | Okayasu et al. | 362/619 |
| 2009/0244892 | A1* | 10/2009 | Xie et al. | 362/236 |

* cited by examiner

*Primary Examiner* — Anh Mai
*Assistant Examiner* — Meghan Dunwiddie
(74) *Attorney, Agent, or Firm* — Eric Fincham

(57) ABSTRACT

A method for modifying a beacon obstruction lighting system to replace the incandescent lamp with an LED lamp. The LED lamp includes a heat sink and is installed to be at the same location as the incandescent lamp.

14 Claims, 2 Drawing Sheets

LED BEACON OBSTRUCTION LIGHTING SYSTEM

FIELD OF THE INVENTION

The present invention relates to warning beacons and more particularly, a beacon obstruction lighting system.

BACKGROUND OF THE INVENTION

The use of obstruction lighting is well known in the art. Such obstruction lighting is typically used on towers, though the use thereof is also known at other locations such as airport runways and the like. Frequently, the use of beacons to warn of an obstruction comprises the use of a strobe lighting system. During the day, a white light is employed while during the night time hours, the intensity of the strobe is diminished.

There are other situations wherein lighting of the tower is not required during the daylight hours, but rather only during the night time hours. Typically, such towers can be painted for visual warning during the daylight hours, the tower typically having bands of red and white. In such situations, the warning beacons typically use incandescent lamps as being a far less expensive option.

One of the down sides to the use of incandescent lighting is the operational cost. Typically, such incandescent lighting uses a housing and a glass with a fresnel lens. Frequently, two lamps are employed and use incandescent bulbs of 700 watts capacity for each. The electricity cost can be substantial.

It is also known in the art to use LEDs as a source of illumination. This has the advantage of substantially reducing the operational costs; however, typically these devices have a plastic case and lens which deteriorates over a period of time. A typical life span would be 10 years, at which point in time the whole assembly must be replaced.

It is an object of the present invention to provide a beacon warning system which is inexpensive to operate while having a long life span.

It is a further object of the present invention to provide a method for the replacement of incandescent lamps in a beacon system.

According to one aspect of the present invention there is provided a method for modifying a beacon having a housing, fresnel type lens, and an incandescent lamp, comprising the steps of removing the incandescent lamp and installing an LED assembly comprising an LED lamp and a heat sink to replace the incandescent lamp, the LED lamp being installed at the same location as the incandescent lamp, the LED lamp having a diameter of between 15 and 45 mm.

According to a further aspect of the present invention there is provided a replacement kit for a beacon having a housing, fresnel lens and an incandescent lamp assembly therein, the retrofit kit comprising an LED lamp having a diameter of between 15 and 45 mm, a heat sink and mounting arrangement such that the LED lamp is mounted at the same height where the incandescent lamp would be mounted, the LED lamp having a diameter of between 15 mm and 45 mm.

As the world becomes more energy conscious, the development of lighting systems utilizing less power has become desirable and indeed, many such systems exist. Typically, they use high performance LED's to substantially reduce energy costs. However, typically these systems will be formed of plastic materials which, given the hostile environment in which they are utilized, normally deteriorate and have to be replaced.

At the present time, there are many obstruction lighting systems which use beacons having incandescent lamps. As these beacons are formed of glass and metal, they have a substantially longer life span. However, if they are replaced with LED beacons, then the housing and lens become scrap.

As used herein, the term LED lamp refers to any structure which uses LEDs to emit light. Frequently, the LED lamp of the present invention is made up of a plurality of LED lights arranged together on a common base or mounting member.

According to the present invention, the housing and lens can still be utilized with LED lighting. However, it has been found that certain dimensions are critical for the practice of the present invention.

The present invention will essentially recycle many of the existing warning beacons which have a metallic body and a glass lens. By replacing the incandescent lights with LED's there is a substantial energy saving and furthermore, the use of LED's will minimize future maintenance and downtime thereby leading to even further reduced costs.

As many beacons have two incandescent lights, one may utilize two LED lamps, as will be discussed hereinbelow, to replace the incandescent lights. However, it may, in certain circumstances, be desirable to only replace one of the incandescent lamps which then can be employed to prevent thermal shock as far as the LED's are concerned. Furthermore, the incandescent bulb could be utilized to melt ice or snow from the housing if so desired. The modified beacon of the present invention thus may have either one or two LED assemblies.

The LED assembly will include a heat sink on which the LED's are mounted. The heat sink will have means associated therewith for securing the same in a beacon housing. Thus, one may use legs to permit the LED assembly to replace the lower incandescent bulb and arms to hang the LED assembly when it replaces the upper incandescent bulb. Needless to say, many suitable mounting means may be utilized.

The LED lighting assembly of the present invention may utilize a plurality of LED lights mounted in a circular type arrangement for maximum visibility. In this arrangement, it is critical that the LED lights be mounted such that the lamp will have a diameter of between 15 and 45 mm and even more preferably, a diameter of between 25 and 35 mm.

The LED assembly of the present invention as aforementioned, is designed to replace the incandescent lamps in conventional beacons. In this respect, virtually all the beacons in North America are of identical design and use a KOPP glass lens. The lens in these beacons is of a red color.

The heat sink utilized with the LED assembly of the present invention naturally must be sized to dissipate the heat generated by the light assembly or assemblies. A preferred version will be illustrated in the detailed description of the invention. It is important that the heat sink be properly shaped so as not to block any light.

The LED assembly will require a driver and associated electronics. This may be mounted at either the top or bottom of the housing with the driver being put in a Faraday cage. Conveniently, this may take the form of a cylindrical disc.

DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
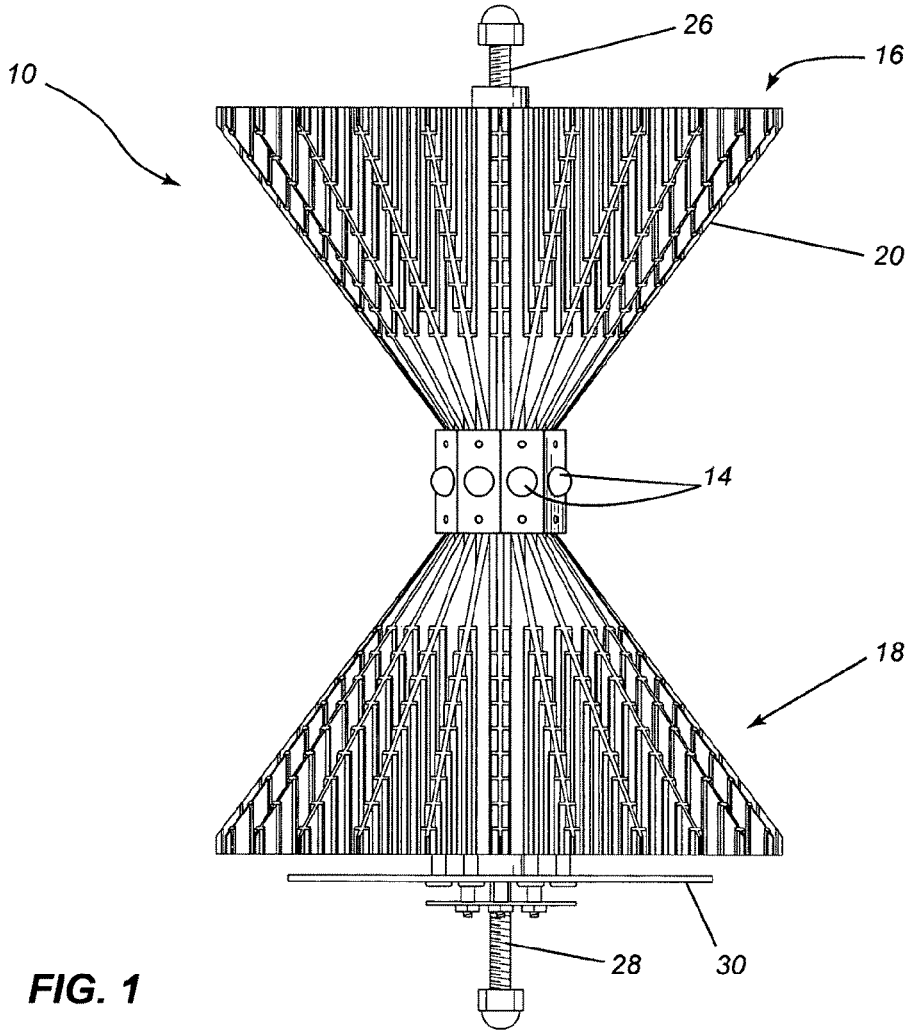
FIG. 1 is a side elevational view of a LED lighting assembly according to the present invention.
Figure 2:
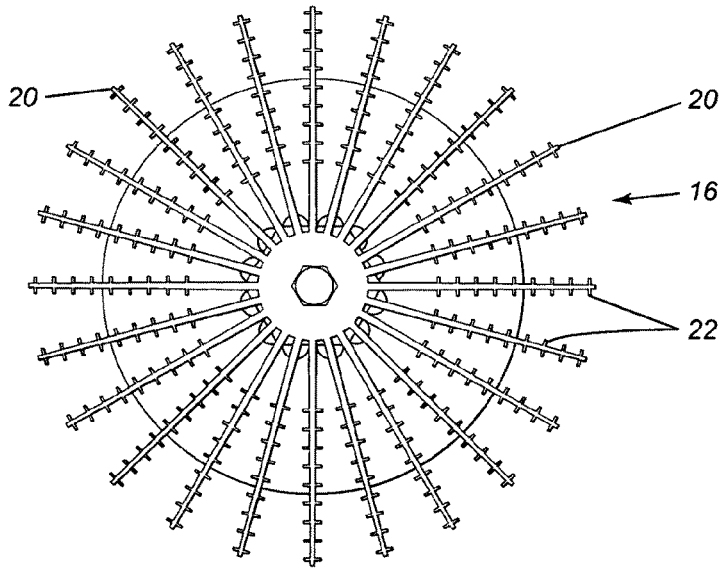
FIG. 2 is a top plan view thereof.

Referring to the drawings in greater detail and by reference characters thereto, there is provided an LED lighting assembly which is generally designated by reference numeral 10.

LED lighting assembly 10 includes a plurality of LED lights 14 mounted on a suitable base. There is also provided an upper heat sink 16 and a lower heat sink 18 which are substantial mirror images and thus only one will be described herein. Each heat sink is formed of a plurality of triangularly shaped plates each of which has fins extending therefrom. The overall configuration of each of the heat sinks is frustraconical to permit proper dispersion of light from LED lights 14.

The LED lighting assembly 10 is provided with an upper mounting bolt 26 and a lower mounting bolt 28. As shown in FIG. 1, there is provided a control housing 30 for mounting the driver and other associated electronics. The arrangement is that of a Faraday cage.

The LED lighting assembly 10 is placed within the beacon which includes an upper housing 34 and a lower housing 36 with a fresnel lens 38 extending thereabout.

As previously mentioned, the diameter of the assembly of LED lights 14 is important and preferably is not smaller than 15 mm and no larger than 45 mm. A more preferred diameter would be between 25 and 35 mm.

Figure 3:
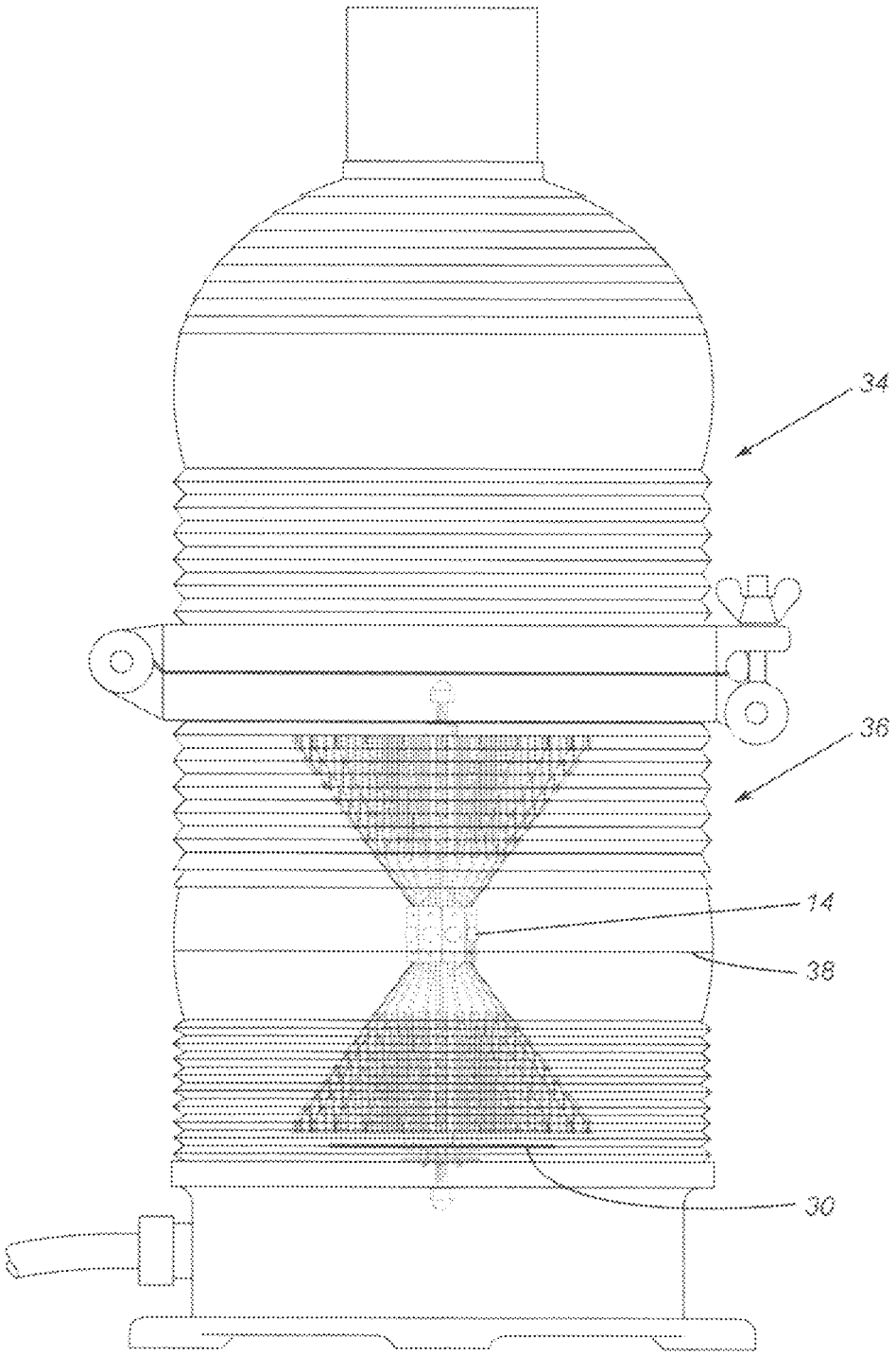
FIG. 3 is a side elevational view of the LED assembly in a recycled housing and lens.

In replacing the known incandescent lamps the LED lighting assembly 10 is inserted within the beacon formed of the lower housing 34 and lens 38. It is important that the LED lights 14 be at the same height as the filament of the incandescent bulb. The incandescent lamp in the upper housing 34 may also be replaced with an LED lighting assembly. As may be seen in FIG. 3, a vertical axis of the beacon will coincide with a vertical axis of the ring of LED's.

It will be understood that the above described embodiment is for purposes of illustration only and that changes and modifications may be made thereto without departing from the spirit and scope of the invention.

We claim:

1. A method for modifying a beacon having a top, a bottom, a housing intermediate said top and bottom, a beacon vertical axis extending between said top and bottom, a fresnel type lens located centrally of said housing, and an incandescent lamp, comprising the steps of:

removing said incandescent lamp; and installing an LED assembly comprising an LED lamp and a heat sink to replace said incandescent lamp, said LED lamp being installed in the same location as said incandescent lamp, said LED lamp comprising a plurality of LED's arranged in a horizontal ring configuration, said horizontal ring having a ring vertical axis which coincides with said beacon vertical axis whereby said LED's will emit light through 360°, said horizontal ring configuration having a diameter of between 15 and 45 mm.

2. The method of claim 1 wherein said LED lamp has a diameter of between 25 mm and 35 mm.

3. The method of claim 2 wherein said LED lamp is installed with a heat sink at the top and bottom of said LED lamp.

4. The method of claim 1 wherein said heat sink has a frustraconical configuration.

5. The method of claim 3 wherein said heat sink comprises a plurality of spaced triangular plates.

6. The method of claim 5 further including fins extending outwardly from each of said triangular plates.

7. The method of claim 1 wherein the beacon has two incandescent lamps, the method further including the step of removing both incandescent lamps and installing first and second LED light assemblies.

8. A replacement kit for a beacon having a top, a bottom, a housing, a fresnel lens and an incandescent lamp assembly therein, a beacon vertical axis extending between said top and bottom, the retrofit kit comprising an LED lamp having a diameter of between 15 and 45 mm, a heat sink and mounting arrangement such that said LED lamp is mounted at the same height where said incandescent lamp would be mounted, said LED lamp comprising a plurality of LED's mounted in a horizontal ring configuration, said horizontal ring configuration having a ring vertical axis which coincides with said beacon vertical axis whereby said LED's will emit light through 360°, said horizontal ring configuration having a diameter of between 15 mm and 45 mm.

9. The kit of claim 8 wherein said LED lamp has a diameter of between 25 mm and 35 mm.

10. The kit of claim 9 wherein said LED lamp is installed with a heat sink at the top and bottom of said LED lamp.

11. The kit of claim 8 wherein said heat sink has a frustraconical configuration.

12. The kit of claim 10 wherein said heat sink comprises a plurality of spaced triangular plates.

13. The kit of claim 12 further including fins extending outwardly from each of said triangular plates.

14. The kit of claim 8 comprising two LED lamps.

* * * * *